US006311632B1

(12) United States Patent
Noel, Jr.

(10) Patent No.: US 6,311,632 B1
(45) Date of Patent: Nov. 6, 2001

(54) PORTABLE PONTOON CRAFT

(76) Inventor: Roland H. Noel, Jr., R.R. 1 Box 2135, Waterboro, ME (US) 04087

( * ) Notice: Subject to any disclaimer, the term of this patent is extended or adjusted under 35 U.S.C. 154(b) by 0 days.

(21) Appl. No.: 09/437,966

(22) Filed: Nov. 10, 1999

(51) Int. Cl.[7] ..... B63B 1/00
(52) U.S. Cl. ..... 114/61.1; 114/61.22; 114/61.24
(58) Field of Search ..... 114/283, 123, 114/61.1, 61.22, 61.24, 343; 441/35, 44, 47, 50, 52, 53, 45, 46; 440/21, 13

(56) References Cited

U.S. PATENT DOCUMENTS

| | | | | |
|---|---|---|---|---|
| 183,777 | * | 10/1876 | Rider | 441/45 |
| D. 374,264 | * | 10/1996 | Peterson | D21/237 |
| 2,775,218 | * | 12/1956 | Kapusnyk | 114/61 |
| 3,473,502 | * | 10/1969 | Wittkamp | 114/345 |
| 3,968,532 | * | 7/1976 | Bailey | 9/2 |
| 4,082,049 | * | 4/1978 | Nicol | 114/39 |
| 4,295,236 | * | 10/1981 | Upchurch | 9/2 |
| 4,303,033 | * | 12/1981 | King | 114/61 |
| 4,315,475 | * | 2/1982 | Echols | 114/61 |
| 4,700,648 | * | 10/1987 | Trefethern et al. | 114/61 |
| 4,730,571 | * | 3/1988 | Hedlund et al. | 114/61 |
| 4,828,517 | * | 5/1989 | Van Liefland | 440/27 |
| 4,854,257 | * | 8/1989 | Grayson | 114/61 |
| 4,892,052 | * | 1/1990 | Zook et al. | 114/61 |
| 5,290,196 | * | 3/1994 | Steel | 441/130 |
| 5,377,608 | * | 1/1995 | Harper, Jr. | 114/61 |
| 5,413,066 | * | 5/1995 | Spencer, Jr. et al. | 114/354 |
| 5,522,741 | * | 6/1996 | Yun | 440/29 |
| 5,619,943 | * | 4/1997 | Kieronski | 114/61 |
| 5,651,706 | * | 7/1997 | Kasper | 440/29 |
| 5,692,450 | * | 12/1997 | Alter et al. | 114/61 |
| 5,711,240 | * | 1/1998 | Baker | 114/61 |
| 5,868,091 | * | 2/1999 | Gross et al. | 114/61 |
| 5,870,966 | * | 2/1999 | Christian | 114/353 |
| 5,878,688 | * | 3/1999 | Merrett et al. | 114/354 |

* cited by examiner

*Primary Examiner*—S. Joseph Morano
*Assistant Examiner*—Lars A. Olson

(57) ABSTRACT

A pontoon water craft includes a pair of spaced apart, floatable, cylindrical, hollow pontoons. A mainframe is mounted between the pontoons having three horizontally spaced apart arcuate shaped harness members extending from each end of a cross bar member. The harness members are overlappingly secured to the upper exterior surfaces of the pontoons and the cross bar members and other mainframe members secure the entire structure together. An upright chair is releasably mounted on the mainframe. A battery provides energy through a steering powerhead to a motor for propelling the craft.

19 Claims, 4 Drawing Sheets

PORTABLE PONTOON CRAFT

BACKGROUND OF THE INVENTION

The invention relates to a portable, stable, durable motor propelled small pontoon water craft having an upright lounge chair to safely and comfortably support a user for recreational purposes.

Motorized and manually self-propelled small pontoon boats have been disclosed previously. Some of these pontoon boats have a pair of opposing pontoons in spaced apart relationship and support a chair on a horizontal support. There are many problems with these small pontoon boats in that they are very unsafe, unduly unstable, extremely uncomfortable, very undurable and incapable of withstanding wear and tear, and are difficult to operate and control.

SUMMARY OF THE INVENTION

The unique portable pontoon craft of the present invention overcomes many of the deficiencies of the prior art chair supported small pontoon boats. In accordance with the present invention, the craft is constructed of two spaced apart, hollow aluminum pontoons mounted to a main frame with a chair releasably mounted on the mainframe. The unique characteristics of the pontoons is that they are fabricated only from aluminum which provides a more durable and stable lightweight water craft without the addition of any floatable material.

The main frame is composed of three spaced apart yoke harness members looped over and overlappingly secured to the pontoons at opposite ends and having cross bar elements securing the entire structure together. A midframe having elongated tubing members secured lengthwise to the three spaced apart yoke harness members prevent shearing between the pontoons and holds the pontoons parallel to each other. The positioning of the yoke harness members prevents the pontoons from flexing outwardly and equally distribute the weight of the craft to the pontoons preventing the pontoons from rolling. The midframe also provides increased strength and stability to the main frame and provides a support for the battery.

A lounge chair having three leg supports is releasably secured to the cross bar elements of the yoke harness members by means of retaining clips. The positioning of the chair fitting snugly between the pontoons equally distributes the weight of the user within the structure. The positioning of the battery beneath the chair further stabilizes the craft.

The craft is easily and comfortably operated by the steering power head secured to the right pontoon adjacent to the seating area of the chair. The power head communicates with the motor driving the propeller at the rear of the craft being energized by the battery. The steering mechanism extending from the power head to the power unit includes shaft collars having steering brackets movably attached to a connecting rod.

DETAILED DESCRIPTION OF THE PREFERRED EMBODIMENT

Figure 1:
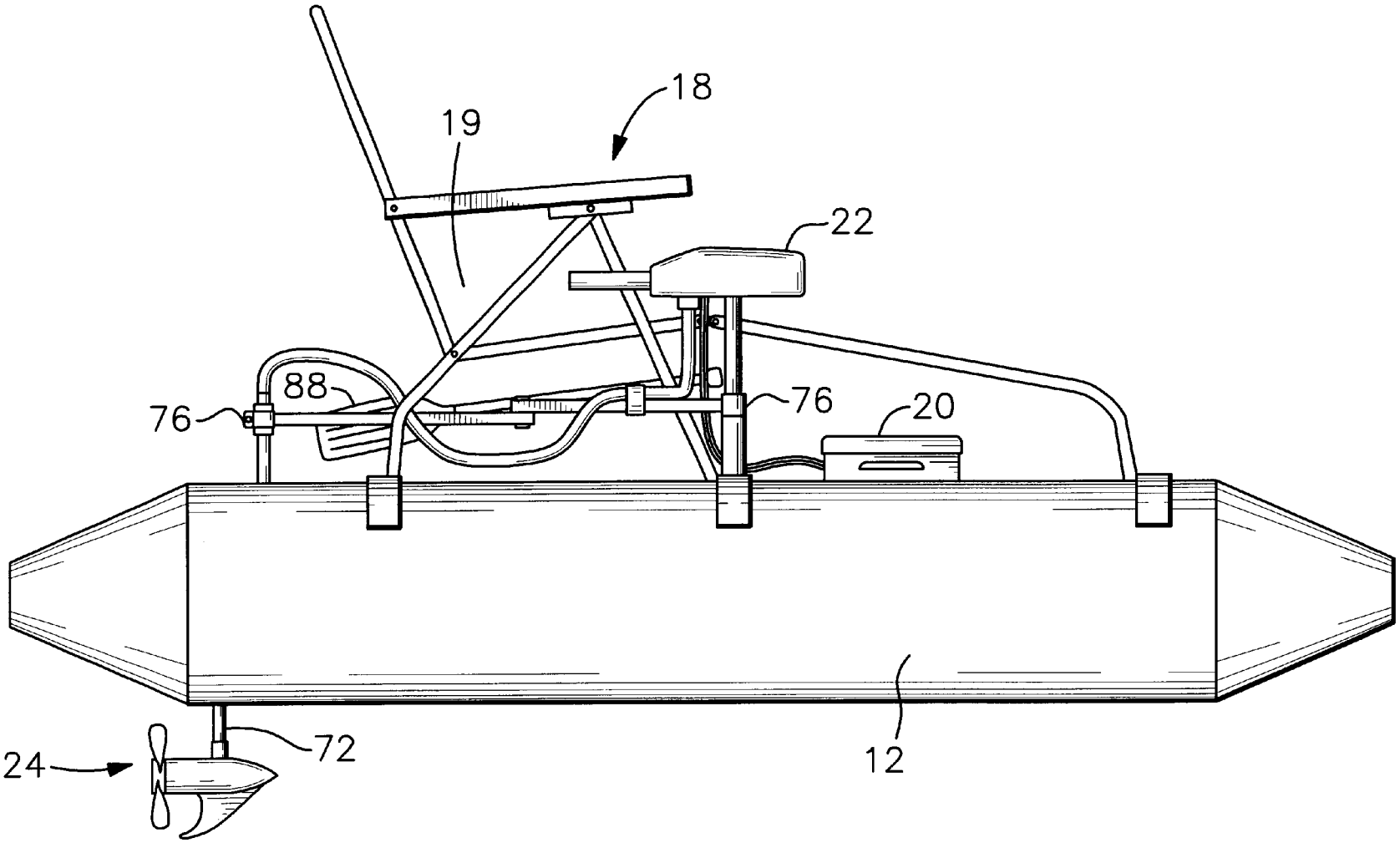
FIG. 1 is a right side view of the portable pontoon craft of the invention.
Figure 2:
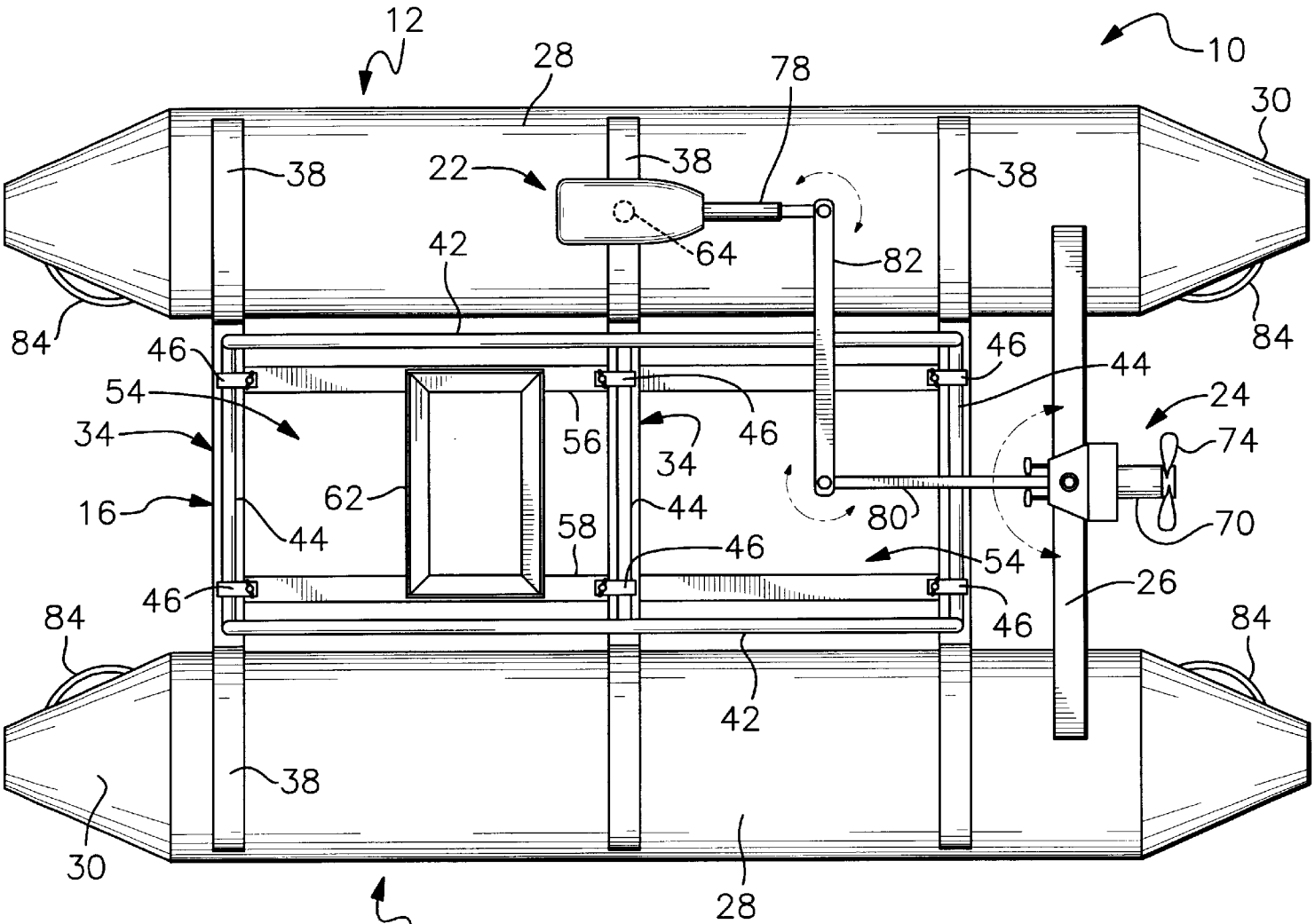
FIG. 2 is top view of the main frame attached to the pontoons with the bottom of the chair frame.

Shown in FIG. 1 is a right side view of the structure of the portable pontoon craft 10 of the invention. The craft also as seen in FIG. 2 is constructed of two parallel spaced apart right and left aluminum pontoons 12 and 14 respectively, mounted to a main frame 16, and a lounge chair 18, also mounted on the main frame. An encased battery 20, which is secured within the forward section of main frame 16 powers the craft. A steering power head 22, which is communically connected to the battery is mounted on right pontoon 12 adjacent to the seating area of chair 19. A lower power unit 24 which is communically connected to steering power head 22 is mounted to a transom 26 located in the rear and propels the pontoon craft.

Aluminum pontoons 12 and 14 are preferably fabricated from 5052 aluminum about 0.063 inch in thickness. Each pontoon has a hollow cylindrical interior body component 28 open at each end, about sixty eight inches in length and about fourteen inches in outside diameter. Aluminum cone components 30, secured at each end of the body component 28, are about eight and one half inches in length and about fourteen inches in diameter terminating to about three inches in diameter at the enclosed end. All seems and the body and cone components are secured preferably by welding by means of a tig process. The entire length of the pontoons is slightly more than seven feet, preferably about eighty five inches. The unique characteristics of the pontoons of the invention are that they are fabricated only from aluminum which distinctly differentiates the present small pontoon craft 10 from all previous small pontoon boats by providing more durable and stable floatable pontoons without the addition of any other floatation material.

Pontoons 12 and 14 are firmly secured and stabilized by means of the main frame 16 shown in FIG. 2. The main frame is composed of three horizontal spaced apart yoke harness members 34 secured to the pontoon body components 28 and an interior rectangular midframe member 54 secured to the yoke harness members 34.

Figure 3:
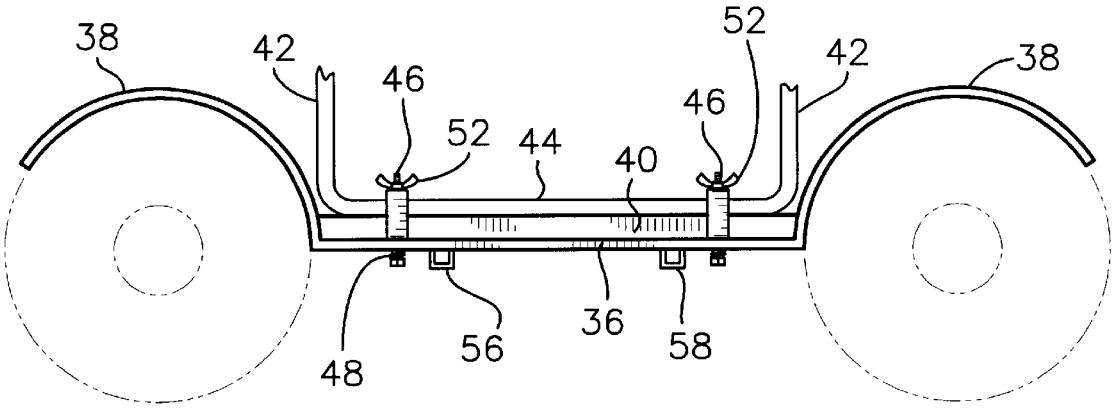
FIG. 3 is view of the yoke harness member attached to base of the chair frame.

The basic support of the main frame as shown in FIG. 3 are the three aluminum yoke harness members 34, each having a central yoke cross bar element 36 terminating in two opposing spaced apart inverted U-shaped loop harness elements 38 as shown in FIG. 3. The unique yoke harness member 34 of the invention is somewhat similar in appearance, and thus the name, to a conventional yoke used for harnessing together oxen or other working animals except that the loop harness element 38 is inverted U-shaped and secured or preferably integrally secured at its bottom inner side base to the central yoke cross bar element 36.

The three yoke harnesses 34 are secured to the pontoon body components 28 at three opposed spaced apart locations within about the front, middle, and rear areas lengthwise of the opposing pontoons. The inverted U-shaped loop harness elements are overlappingly secured to the top and upper side surfaces of the opposing pontoon body components 28 by welding or other equivalent securing means. The central cross bar element 36 extends horizontally between about the middle internal surface of the pontoons.

A major advantage of the three spaced apart aluminum yoke harness members looped around the pontoons is that they prevent the pontoons from flexing outwardly. Additionally, the position of the yoke harness members on the pontoons equally distributes the weight of the craft to the pontoons preventing the pontoons from rolling.

Increased strength to the yoke harness and main frame is provided by an aluminum rectangular cross support tubing element 40 having about the same length, generally about twenty two inches, and width, generally about two inches as the central cross bar element 36. The cross support tubing element 40 is secured to the top surface of the cross bar element preferably by welding or other equivalent securing means. The addition of the aluminum cross support tubing element 40 increases the strength and stability of the yoke harness and main frame in supporting the pontoons and the chair 18.

Preferably, the aluminum yoke harness members 34 are formed from in one piece by means of a one eighth inch by two inches aluminum flat stock placed in a jig. After allowing for the approximately twenty two inches central cross bar element 36, the opposite ends are formed into the inverted U-shape loop harness elements 38 to fit the curvature of the pontoons. Next, the one by two inch tubing support 40 is fitted onto and secured to the top surface of the cross bar element 36. The entire yoke harness member 34 with tubing support 40 attached is secured to the pontoons. It is this unique one piece yoke harness member which holds the entire structure together and stabilizes the entire structure.

The midframe 54 shown in FIG. 2 includes two opposing aluminum elongated parallel spaced apart midframe square tubing members 56 and 58 secured to the underside of central yoke cross bar elements 36 extending lengthwise between the pontoon body compoents 28 and parallel therewith. The midframe tubing members are located within about three inches inside of the pontoon tubing members and secured to the bottom surfaces of the three central yoke cross bar elements 36 by welding or similar securing means. Generally, each midframe square tubing member is about one by one inch squre and about fifty six inches in lenght initiating at about two inches to the rear of the front cone member and terminating at about ten inches in front of the rear cone member. The positioning and securing of the midframe tubing members 56 and 58 to the underside of the yoke harness central cross bar elements 36 in conjunction with other members of the main frame prevent shearing between the pontoons by helping to hold the pontoons parallel and preventing the pontoons from proceeding forward or backward in opposition to each other. The midframe 56 also provides increased strength and stability to the main frame and provides a support for the battery 20 and other materials and supplies.

Figure 4:
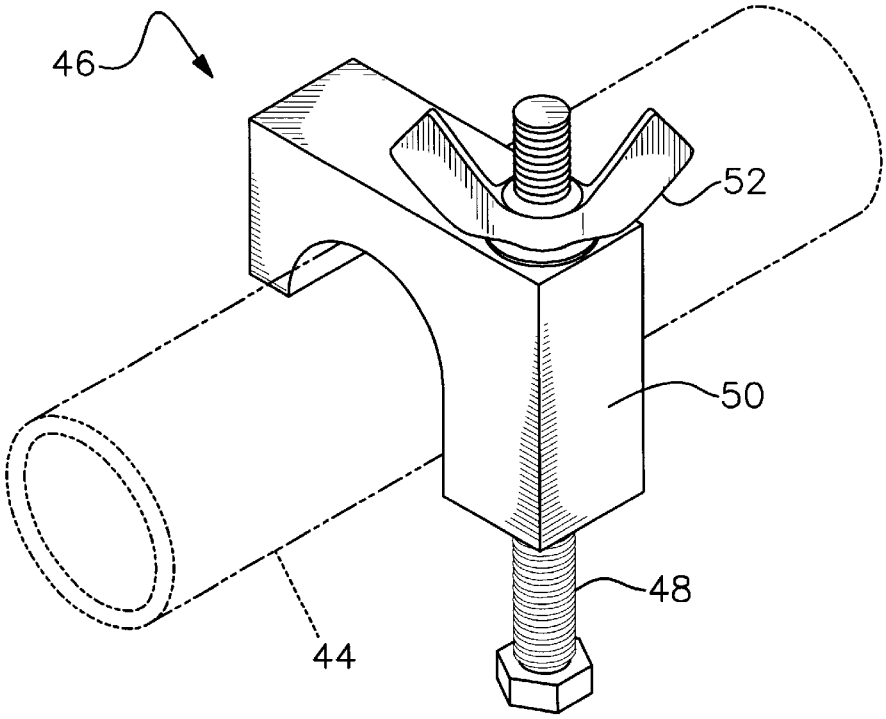
FIG. 4 is a view of the retaining clip.
Figure 5:
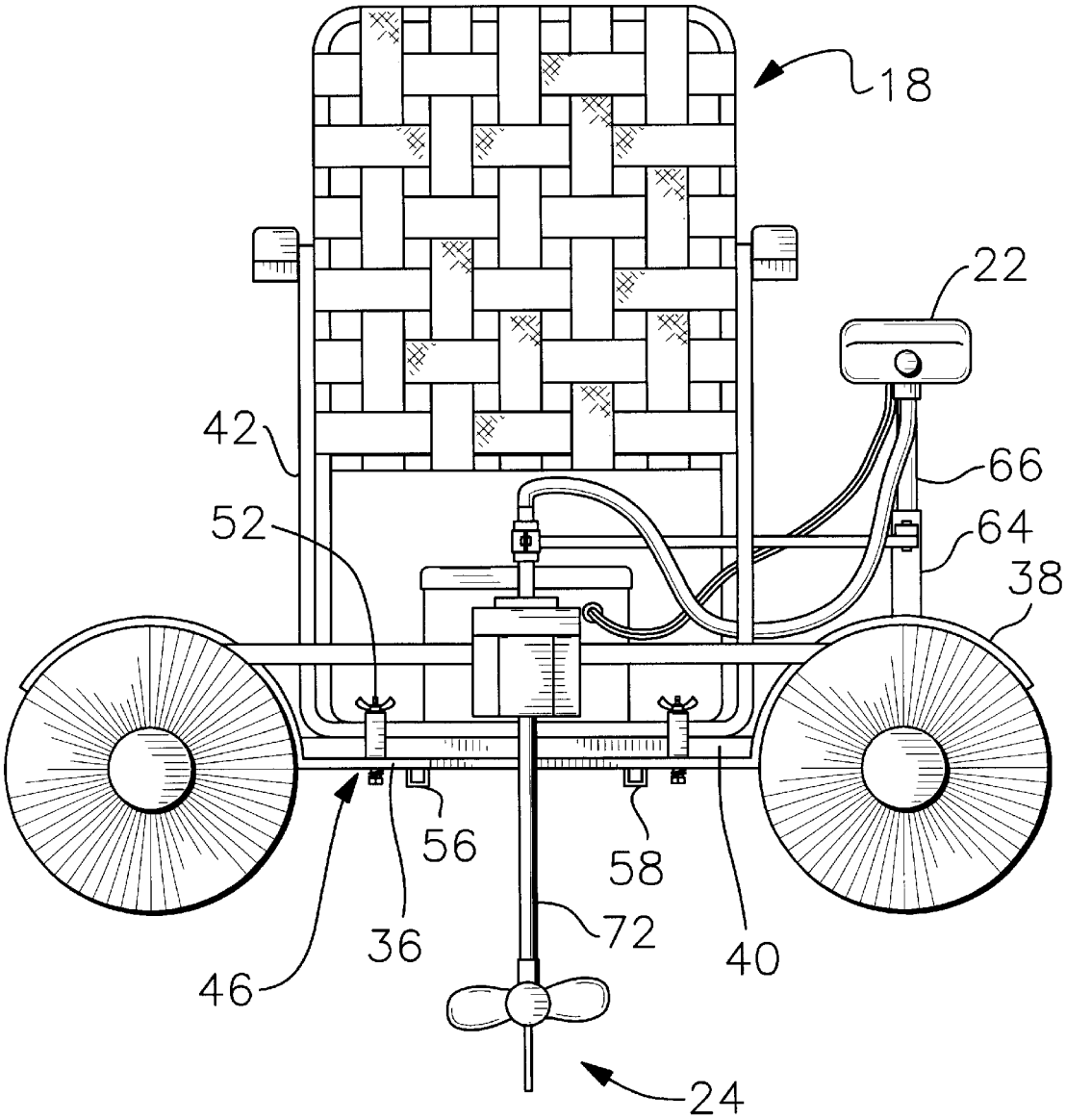
FIG. 5 is a view of the rear of the craft.

The chair 18 as seen in FIGS. 1 and 5 is similar to an aluminum beach lounge chair having fabric or plastic seating material, an aluminum chair frame having a reclining back and three upstanding tubular supports 42. Each leg support is releasably secured at its base horizontal tubing 44 to cross bar tubing element 40 and cross bar element 36 by a spring retaining clip 46 shown in FIG. 4. Preferably, the upstanding tubular leg supports 42 as indicated in FIGS. 3 and 5 are adapted and aligned to fit between the pontoons at the inside edge of the loop harness element 38 Generally, the width of the horizontal base leg support is about twenty two inches to fit snugly within the pontoons. When the chair is fitted in place on the cross bar tubing element 40, the leg supports are then secured to it and cross bar element 36 by the spring retaining clip. When the chair is secured to the mainframe, only the back of the chair is movable from a vertical to a reclining position. Although a lounge chair is shown in the drawings, it is understood that other types of chairs are applicable. However, the design of chair 18 with its three supports 42 is beneficial to the total comfort and complete support of the entire body of the user for operating the craft indefinitely without becoming fatigued.

The retaining clip 46 as shown in FIG. 4 includes a spring loaded stud 48 treadedly engaged by a wing nut 52 in a solid aluminum metal block 50 having a U-shaped configuration. The horizontal base leg support 44 of the chair is secured to each cross bar tubing element and cross bar element by mounting the inverted U-shaped block 50 over the horizontal tubular leg base support element 44, passing the spring loaded stud 48 through bore holes which have been drilled through the cross bar element 36 and support tubing element 40 and treadedly engaging stud 48 with wing nut 52.

Located beneath the leg area of the seat is the waterproof encased battery 20 secured to the midframe 54. The battery is secured on one by one inch aluminum angle bars rectangular support 62 secured to the opposing tubing members 56 and 58 as seen in FIGS. 1 and 2. Encased wiring proceeds from the battery to a quick disconnect device and to the powerhead 22 in supplying energy to operating the craft. The predetermined location of the battery in the front center of the structure helps to equally distribute the weight and to stabilize the craft. Generally, the battery is quite heavy in proportion to the weight of the craft. The location of the battery is determined by first placing the craft in the water and then placing the battery in the proper position in the midframe to obtain the desired pitch of the craft to glide through the water. If the battery is set too far forward, the craft will become unsafe by plowing through the water because of the excessive forward weight.

The steering powerhead 22 is located on the right side of the seating section of the chair. The powerhead is secured in an upright position within an aluminum shaft support 64 extending upwardly from the aluminum middle yoke loop harness element 38 which is secured to the right pontoon adjacent to the chair seating section by welding or other securing means The powerhead 22 is a commercial unit having a handle, unit shaft 66, interior wiring and a speed switch energized from the battery. The powerhead is in mechanical and electrical communication with the rear lower power unit in steering and propelling the craft.

The lower power unit 24 is mounted on the transom 26 at the rear of the chair. The transom is an aluminum cross bar, preferably two by two inches square tubing, secured at each end by welding or equivalent means to the upper surface of the opposing pontoon body components 28 slightly to the rear of the main frame. The lower power unit is a commercial system including an electrical motor 70 mounted on a motor shaft 72 and having a propeller 74. The motor and propeller are located below the pontoon body components 28 in front of the rear cone components 30.

The mechanical steering of the craft is accomplished by means of two shaft collars 76 on the powerhead and motor providing steering brackets 78 and 80 movably attached to a connecting rod 82. One each of the two shaft collars 76, preferably stainless steel circular ring, is mounted on the power head shaft 66 and on the motor shaft 72. Connected to and extending rearwardly from the power head shaft collar and extending forwardly from the motor shaft collar are aluminum steering brackets 78 and 80 which are movably secured at each end of cross connecting rod 82. The convenient location of the handle on the power head adjacent to the seating area permits easy steering of the craft while being comfortably seated in a relaxed position.

Shown on the top surfaces of the pontoons are handles 84 attached to the front and rear, a paddle 88 releasably secured tot he chair leg supports and a slip resistant covering.

While the present invention has been described and illustrated with respect to the preferred embodiments, it will be appreciated that variations of the invention may be made without departing from the scope of the invention which is defined in the appending claims.

What is claimed is:

1. A small pontoon water craft comprising a pair of elongated, parallel, spaced apart floatable cylindrical hollow aluminum pontoons having upper and inner exterior surfaces, an aluminum mainframe mounted inbetween said pontoons upper and inner exterior surfaces comprising a plurality of horizontally spaced apart arcuate shaped harness members extending upwardly from each end of an intermediate horizontal cross bar member, said harness members overlappingly secured to said upper and inner exterior surfaces down to about a mid point on said inner exterior surfaces and said cross bar member extending horizontally inbetween the pontoons, a cross support tubing member secured horizontally to the top surface of the cross bar member, and a chair having U-shaped leg supports releasably mounted on the cross bars by means of a spring loaded stud encased in an arcuate shaped block.

2. A pontoon craft according to claim 1 wherein there are three spaced apart arcuate shaped harness members.

3. A pontoon water craft according to claim 1 having a handle means mounted on each end of the pontoons.

4. A pontoon water craft according to claim 1 wherein two elongated opposing tubing members are secured lengthwise to the inner surfaces of the pontoons and to the harness members.

5. A pontoon watercraft accoeding to claim 1 wherein an upright chair having a seating area is releasably mounted on the cross bar members.

6. A pontoon water craft according to claim 5 wherein the chair includes three leg support members releasably mounted on the three cross bar members.

7. A pontoon water craft according to claim 6 wherein the chair includes a reclining back support.

8. A pontoon water craft according to claim 7 wherein the chair includes three U-shaped leg supports releasably mounted to the three cross bar members and the support member.

9. A pontoon water craft according to claim 8 wherein a retaining means releasably mounts the leg supports.

10. A pontoon water craft according to claim 9 wherein the retaining means has a spring loaded stud encased in an arcuate shaped block.

11. A pontoon water craft according to claim 10 wherein an encased battery is mounted on the midframe at the center of gravity of the craft.

12. A pontoon water craft according to claim 11 wherein a steering powerhead is mounted on the upper surface of a pontoon adjacent to the seating area of the chair.

13. A pontoon water craft according to claim 12 wherein the steering powerhead is in mechanical and electrical communication with a power unit in rear of the craft.

14. A pontoon water craft according to claim 13 wherein the power unit comprises a motor and propeller unit.

15. A pontoon water craft according to claim 4 wherein aluminum cone components are secured at each end of the pontoons.

16. A pontoon water craft according to claim 15 wherein the length of the pontoons with the aluminum cone components is about seven feet.

17. A method of constructing a small pontoon water craft comprising providing a pair of elongated, parallel, spaced apart, floatable cylindrical aluminum pontoons having upper and inner exterior surfaces, mounding an aluminum mainframe inbetween said pontoons by overlappingly securing upwardly extending arcuate shaped harness members to said upper and inner exterior surfaces down to a midpoint on said inner exterior surfaces from each end of an intermediate horizontal cross bar member to the opposing pontoons upper and inner exterior surface and extending the cross bar member horizontally in between the opposing pontoons and releasably mounting U-shaped leg supports of a chair on the cross bars by means of a spring loaded stud encased in an arcuate shaped block.

18. A method according to claim 17 wherein a cross support tubing member is secured horizontally across the top surface of the cross bar member.

19. A method according to claim 18 wherein a midframe is formed by mounting two elongated opposing tubing members lengthwise to the harness members.

* * * * *